US007537487B2

(12) United States Patent
Shan et al.

(10) Patent No.: US 7,537,487 B2
(45) Date of Patent: May 26, 2009

(54) CROSSTALK REDUCTION IN DUAL INLINE MEMORY MODULE (DIMM) CONNECTORS

(75) Inventors: Lei Shan, Yorktown Heights, NY (US); Jiali Wu, Yorktown Heights, NY (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 12/117,864

(22) Filed: May 9, 2008

(65) Prior Publication Data

US 2008/0207059 A1 Aug. 28, 2008

Related U.S. Application Data

(63) Continuation of application No. 11/422,654, filed on Jun. 7, 2006, now Pat. No. 7,407,415.

(51) Int. Cl.
*H01R 24/00* (2006.01)

(52) U.S. Cl. ..... 439/637; 439/941

(58) Field of Classification Search ..... 439/637, 439/941, 55

See application file for complete search history.

(56) References Cited

U.S. PATENT DOCUMENTS 5,358,775 A 10/1994 Horn, III
5,652,055 A 7/1997 King et al.
6,517,375 B2 * 2/2003 MacLaren et al. ..... 439/489
6,528,145 B1 3/2003 Berger et al.
6,570,097 B2 * 5/2003 Monde et al. ..... 174/137 B
6,586,791 B1 7/2003 Lee et al.
6,765,779 B2 * 7/2004 Stevenson et al. ..... 361/302
6,930,240 B1 8/2005 Giboney et al.
6,979,890 B2 12/2005 Kambe et al.
7,310,216 B2 * 12/2007 Stevenson et al. ..... 361/302
2001/0014004 A1 8/2001 Sanville, Jr.
2002/0182935 A1 12/2002 Monde et al.
2005/0277331 A1 12/2005 Hall

OTHER PUBLICATIONS

JP2005004985A "High Frequency Dielectric Material and Electronic Component". (Abstract Only).

* cited by examiner

*Primary Examiner*—Hae Moon Hyeon
(74) *Attorney, Agent, or Firm*—Cantor Colburn LLP; Jesse Abzug

(57) ABSTRACT

A DIMM connector having reduced crosstalk includes ceramic particles having a high dielectric constant and/or composite fibers mixed into materials used for fabricating a connector housing of the DIMM connector.

1 Claim, 6 Drawing Sheets

CROSSTALK REDUCTION IN DUAL INLINE MEMORY MODULE (DIMM) CONNECTORS

CROSS REFERENCE TO RELATED APPLICATION

This application is a continuation application of U.S. Ser. No. 11/422,654, filed Jun. 7, 2006, the contents of which are incorporated by reference herein in their entirety.

TRADEMARKS

IBM® is a registered trademark of International Business Machines Corporation, Armonk, N.Y., U.S.A. Other names used herein may be registered trademarks, trademarks or product names of International Business Machines Corporation or other companies.

BACKGROUND OF THE INVENTION

1. Field of the Invention

The invention herein relates to a Dual Inline Memory Module (DIMM) and more particularly to connectors for reducing noise therein.

2. Description of the Related Art

Presently, the Dual Inline Memory Module (DIMM) is arguably the most popular configuration for memory used in personal computers and servers. Unfortunately, with the increased system demands (such as in processor-to-memory and memory-to-memory bandwidth and system operating frequencies), aspects of the DIMM connector are becoming problematic. For example, the DIMM connector is becoming a bottleneck due to significant crosstalk among pins.

For example, in various tests, many DIMM memory prototypes failed to meet performance criteria for data-rates below 2 Gbps. As data-rate demands for fully-buffered DIMM applications are soon to exceed 3 Gbps, improvements to DIMM performance characteristics are required. Preferably, the improvements provide for substantial reductions in crosstalk and thus provide for extending DIMM usage to higher frequencies than presently achievable without any significant changes mechanical designs.

SUMMARY OF THE INVENTION

The shortcomings of the prior art are overcome and additional advantages are provided through the provision of a dual inline memory module (DIMM) connector having a plurality of pins coupled to circuit components, wherein the pins provide for communicating input and output signals with the circuit components, the circuit components and the pins surrounded by and electrically separated by a connector housing, the housing formed of material comprising a plurality of high dielectric constant ceramic particles mixed within the material.

Also disclosed is a method for fabricating a DIMM connector, that includes mixing high dielectric constant ceramic particles within material for the jacketing the circuit components and at least a portion of the pins; and jacketing circuit components and the at least a portion of pins for the DIMM connector with the mix of particles and material to form a connector housing.

Further disclosed is a method for fabricating a DIMM connector, that includes assembling a plurality of pins coupled to circuit components, wherein the pins provide for communicating input and output signals with the circuit components; mixing high dielectric constant ceramic particles having a one of a bi-modal distribution of particle sizes and a multi-modal distribution of sizes having a diameter ranging from in the nanometers to in the micrometers within material for jacketing the circuit components and at least a portion of the pins; wherein a quantity of the ceramic particles is adjusted to control a dielectric constant for a housing of the connector, according to a formula $$\in=[\in_1^{1/3}+v_2(\in_2^{1/3}-\in_1^{1/3})]^3$$

where $\in$ represents a dielectric constant for the connector housing $\in_1$ represents a dielectric constant of the material, $\in_2$ represents a dielectric constant of the ceramic particles; and $v_2$ represents a volume fraction of the ceramic particles in the material; and, jacketing circuit components and the at least a portion of pins for the DIMM connector with the mix of particles and material to form the connector housing.

Additional features and advantages are realized through the techniques of the present invention. Other embodiments and aspects of the invention are described in detail herein and are considered a part of the claimed invention. For a better understanding of the invention with advantages and features, refer to the description and to the drawings.

BRIEF DESCRIPTION OF THE DRAWINGS

The subject matter which is regarded as the invention is particularly pointed out and distinctly claimed in the claims at the conclusion of the specification. The foregoing and other objects, features, and advantages of the invention are apparent from the following detailed description taken in conjunction with the accompanying drawings in which:

The detailed description explains the preferred embodiments of the invention, together with advantages and features, by way of example with reference to the drawings.

DETAILED DESCRIPTION OF THE INVENTION

The teachings herein reduce crosstalk for existing DIMM connectors without substantial changes to the design of the DIMM connectors. Typically, crosstalk reduction is by a factor of about three. These improvements provide for use of DIMM connectors in applications having higher operating frequencies than previously achievable, without any substantial changes to mechanical designs of the DIMM connectors.

In order to provide context for the teachings herein, consider aspects of performance for present day embodiments of DIMM connectors. Both simulations and measurements regarding existing (prior art) DIMM connectors show that single-aggressor crosstalk is approaching −30 dB at operating frequency of about 2 GHz for existing DIMM connector layouts and configurations, and a potential of three effective aggressors may be present in field applications, which tends to result in a greater than −18 dB total crosstalk noise for an operating frequency of about 2 GHz and leads to intolerable bit errors. These problems are addressed by the teachings herein.

Figure 1:
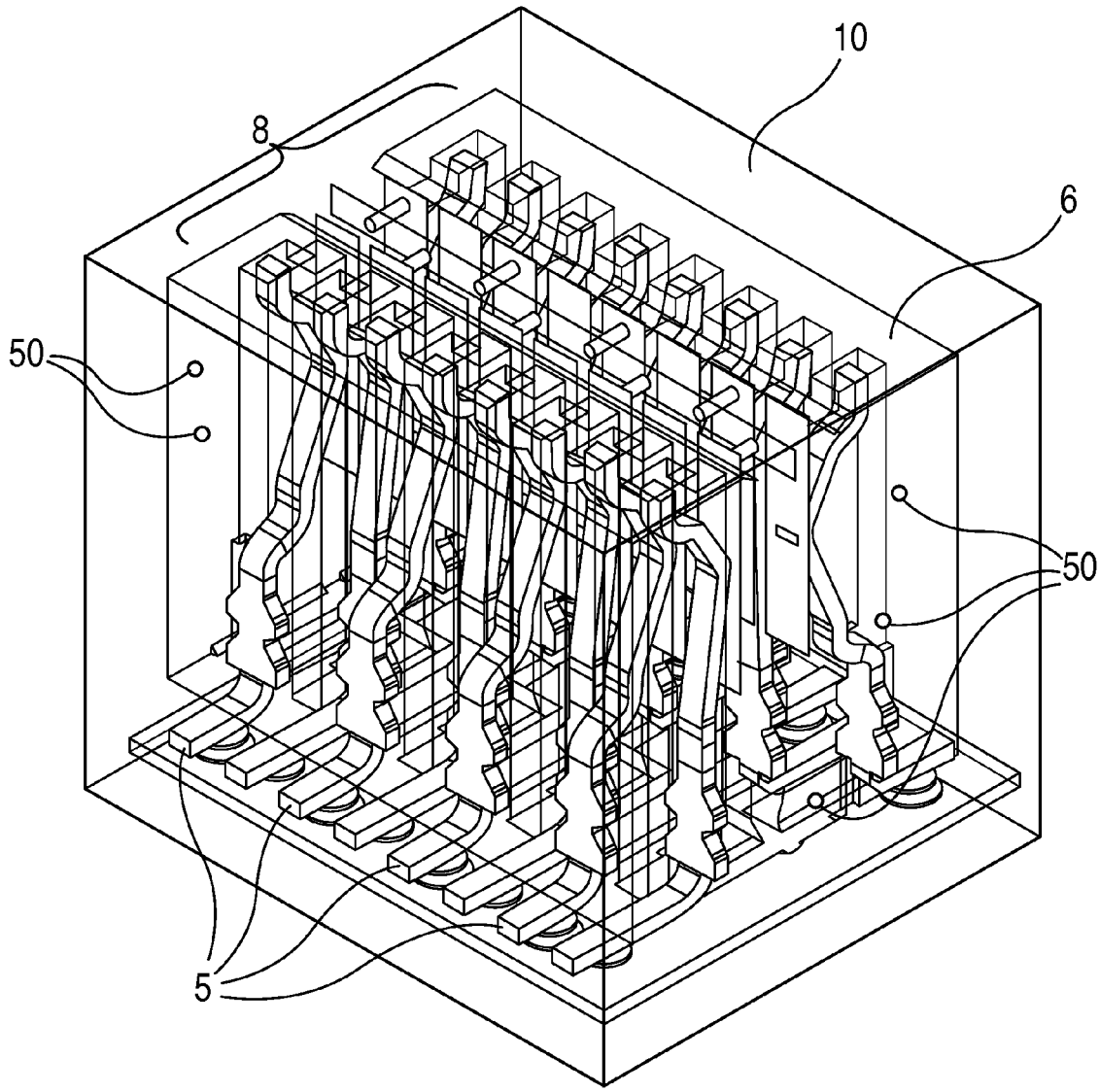
FIG. 1 illustrates one example of components within a DIMM connector according to the teachings herein.

Referring now to FIG. 1, there is shown a cutaway of a portion of a DIMM connector 10 fabricated according to the teachings herein. As with other prior art connectors, the DIMM connector 10 according to the teachings herein provides a receptacle for a DIMM and the coupling of the DIMM to electronic circuits.

Figure 2:
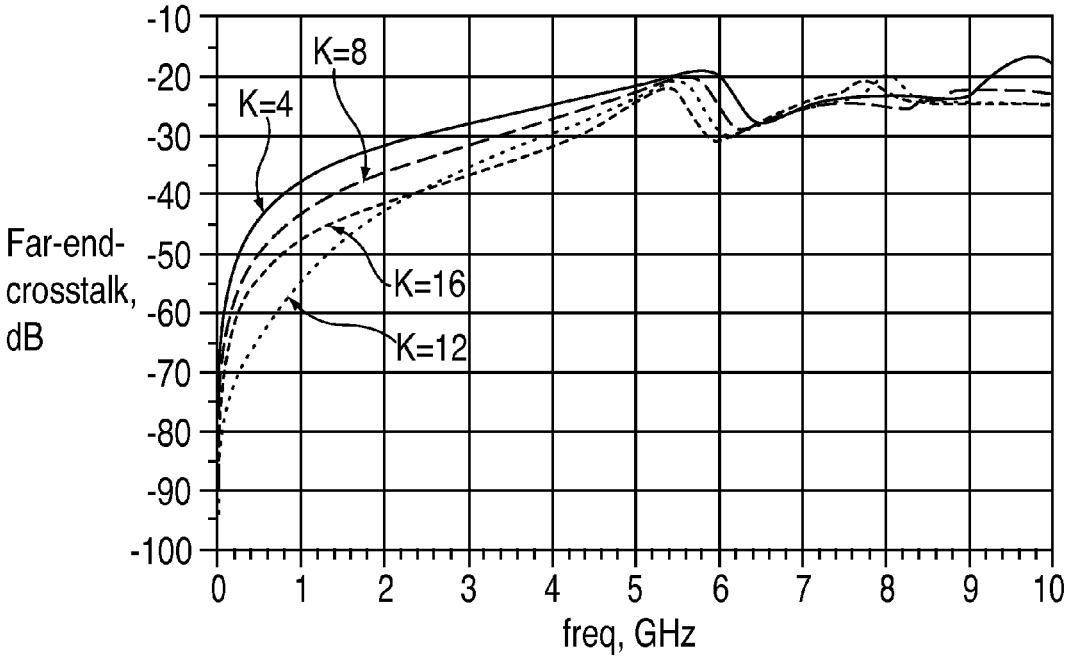
FIG. 2 is a graph illustrating far-end crosstalk for exemplary DIMM connector according to the teachings herein.

In FIG. 1, the DIMM connector 10 includes a plurality of high dielectric constant ceramic particles 50 in the connector housing 6. Of course, the plurality of high dielectric constant ceramic particles 50 depicted in FIG. 2 are shown only for illustration purposes. In reality, the plurality of high dielectric constant ceramic particles 50 are not perceptible when inspected with the unaided human eye.

As shown in FIG. 1, the DIMM connector 10 includes a plurality of pins 5 which are coupled to circuit components 8. The circuit components 8 provide for functionality of the DIMM connector 10 and are known in the art. Exemplary circuit components include DIMM and printed wiring boards, as are known in the art. Accordingly, the circuit components 8 are generally not discussed in any greater depth herein.

When incorporated into the DIMM connector 10, the high dielectric constant ceramic particles 50 raise the effective dielectric constant of the connector housing 6 from a typical value of about 4 (for prior art connectors) to a value of about 16 or higher. The increase in the effective dielectric constant of the connector housing 6 helps reduce pin-to-pin system impedance. With the addition of the ceramic particles 50, the system impedance is typically about 50 ohms, but may range somewhat from this value (depending on various factors). This reduction in system impedance helps to mitigate crosstalk associated with impedance mismatching.

Advantageously, as there is no need for design changes, the teachings herein are compatible with present day designs for DIMM connectors (as well as other types of memory, such as, for example, LGA socket, backplane connectors and PCI-Express). Clearly, the teachings herein provide for minimum cost impact for the attendant performance improvements.

By applying the teachings herein, for a given interconnect structure, the dielectric constant and the shunt capacitance C may be increased and decreased as desired to selected values. That is, by controlling the population of ceramic particles 50, it is possible to achieve a desired impedance. In some embodiments, such as in the case of DIMM connectors 10, impedance between each of the pins 5 is much higher than the system impedance of about 50 ohm (for the prior art). This tends to introduce additional far-end-crosstalk in the DIMM connector 10. Accordingly, design for the DIMM connector 10 calls for increasing the dielectric constant of materials for the connector housing 6 in order to increase shunt capacitance C and bring the impedance down to match the system impedance (of about 50 ohm).

The characteristic impedance $Z_0$ is defined as:

$$Z_0 = \sqrt{\frac{R + jwL}{G + jwC}}; \quad (1)$$

where R represents resistance, L represents inductance, G represents conductance; C represents capacitance, w represents angular velocity and j represents an imaginary number.

To verify the effectiveness of this invention, a 3D full-wave model was created with DIMM geometries as shown in FIG. 2. FIG. 2 provides a graph showing effects of the dielectric constant of the connector housing 6 on far-end-crosstalk. The prior art materials for the connector housing 6 (typically either a polymer carrier or resin) have a dielectric constant of usually about 4. By increasing the dielectric constant K to one of about 8, 12, and 16, far-end-crosstalk may be reduced from −31 dB to about −36 dB, −42 dB, and −41 dB respectively, at 2 GHz (for a fundamental frequency of about 4 Gbps). In this example, the system impedance of the DIMM connector 10 was close to 50 Ohm while the dielectric constant K was about 12. One skilled in the art will recognize that for any specific DIMM connector designs, an optimal value for the dielectric constant K can be obtained with EM full-wave simulations.

Figure 3:
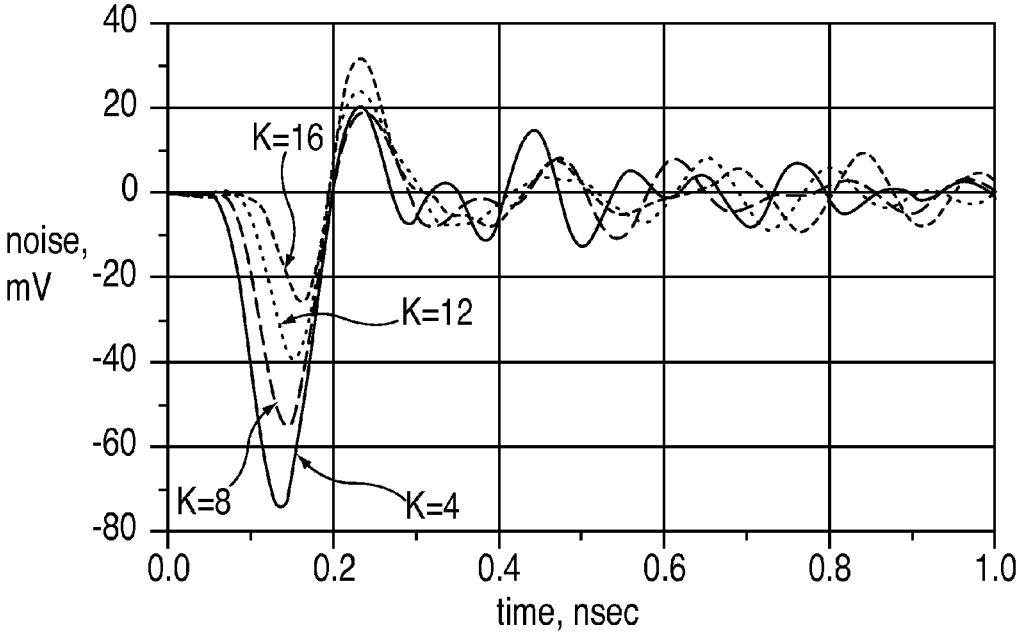
FIG. 3 is a graph illustrating one example of noise for exemplary DIMM connector according to the teachings herein.
Figure 4A:
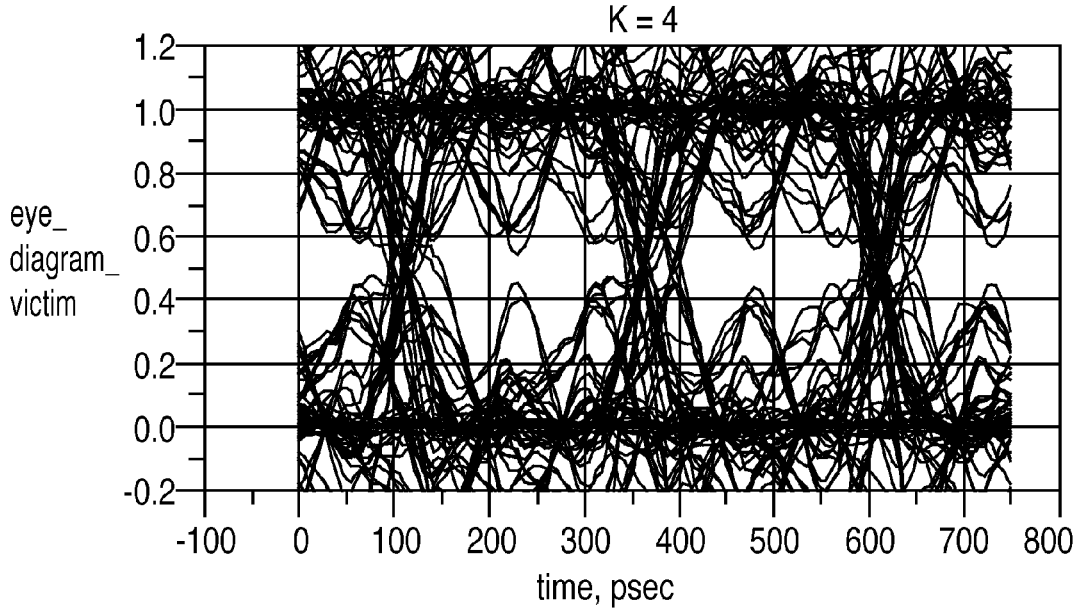
FIGS. 4A-4D, collectively referred to as FIG. 4, is a series of eye diagrams for exemplary DIMM connector according to the teachings herein.
Figure 4B:
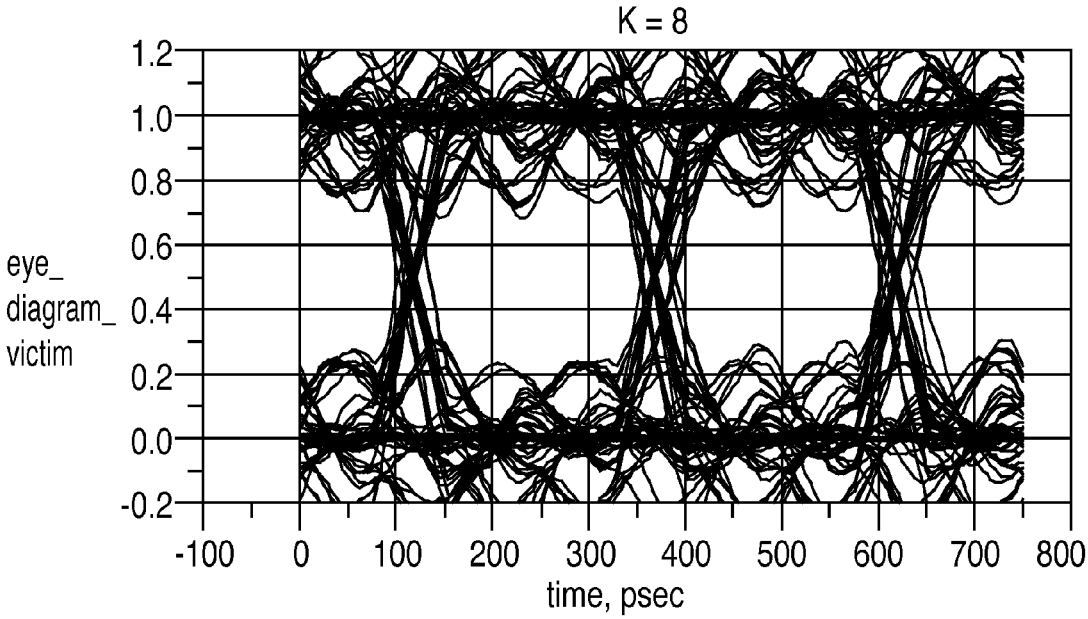
Figure 4C:
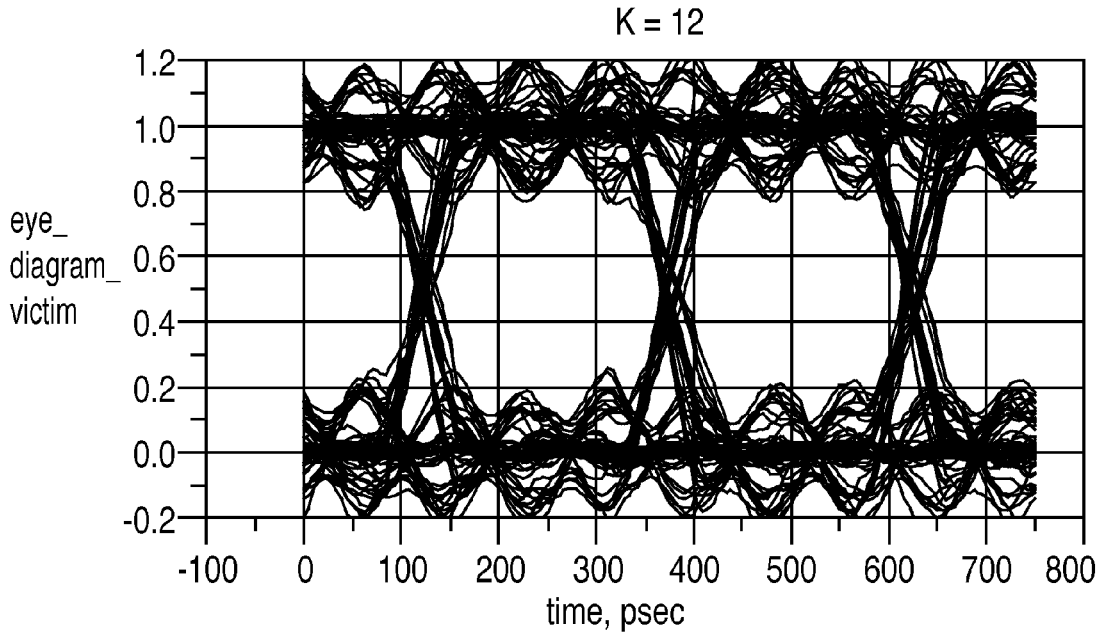
Figure 4D:
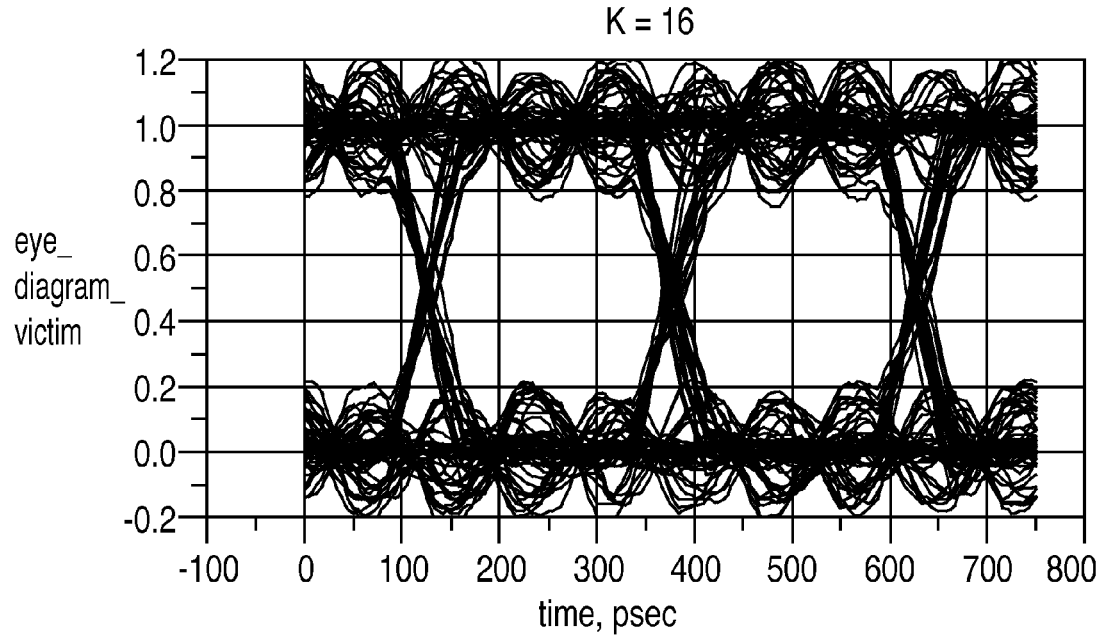

FIG. 3 is another graph depicting crosstalk noise reduction for the selected pin 5. In this example, adjacent aggressor pins 5 were switched from about 0V to about 1V with a 100 psec rise time. For the various dielectric constant K values evaluated, the noise peak was reduced from the original −75 mV down to −55 mV, −40 mV, and −25 mV respectively. Crosstalk noise reduction of a factor of three (from −75 mV to −25 mV) was demonstrated as achievable. One may recognize that these performance enhancements will significantly reduce the bit-error-rate of memory buses and therefore increase operating speed.

FIG. 4 depicts effect of the dielectric constant K on signal integrity across a DIMM connector 10. FIG. 4 is a series of eye-diagrams, where the signal provided was at a data-rate of 4 Gbps and having a rise/fall time of 75 ps. By increasing the dielectric constant K of the DIMM connector housing from 4 to 8, 12, and 16, the vertical eye-opening is improved from 150 mV to 450 mV, 550 mV, and 580 mV respectively (as depicted in FIGS. 4A-4D). One skilled in the art will readily recognize that the vertical eye-opening improvement of about four fold (4 times) will improve performance considerably. For example, improvements may include reducing circuit power and simplifying of equalization schemes.

The method of varying dielectric constant of DIMM connectors 10 proposed in this invention is to add ceramic particles 50 having a high dielectric constant K into material for the connector housing 6 of the DIMM connector 10. The dielectric constant C for the connector housing 6 may be determined using the following formula:

$$\in = [\in_1^{1/3} + v_2(\in_2^{1/3} - \in_1^{1/3})]^3 \quad (2);$$

where, $\in_1$ represents the dielectric constant of the carrier material, and $\in_2$ and $v_2$ represent the dielectric constant and the volume fraction of the ceramic particles, respectively.

As an example, SrTiO3 powder has a dielectric constant of about 300. Using the SrTiO3 powder, a dielectric compound having a dielectric constant K of about 16 may be obtained. This is achieved by adding about 20% SrTiO3 powder into the connector housing material 6. The size of the ceramic particles 50 may range from nanometers in scale to micrometers. Generally, smaller particle size allows greater particle volume fraction as well as better compound stability. In some embodiments, a powder of the ceramic particles includes one of a mono-modal, a bi-modal (two particle sizes) and a multi-modal distribution of particles sizes. The powder may be used to provide a maximum particle volume fraction. The mechanical properties and stability of the resulting housing are typically similar to the prior art materials, and thus do not present design complications.

Of course, materials other than $SrTiO_3$ powder may be used. Accordingly, the use of $SrTiO_3$ powder, $Al_2O_3$, as well as the use of about 20% $SrTiO_3$ powder is merely exemplary and is not limiting of the teachings herein. For example, other materials such as a composite fiber including a metal titanate represented by general formula $M_xTiO_2$ (in the formula, M denoting at least one kind of metal such as Ba, Sr, Ca, Mg, Co, Pd, Be and Cd) and amorphous titanium oxide bound together. One skilled in the art will recognize that the dielectric constant K of the ceramic particles 50 may range from about 4 to about 20,000 or higher.

In some embodiments, composite fibers are included in addition to, or in place of, the ceramic particles.

Figure 5:
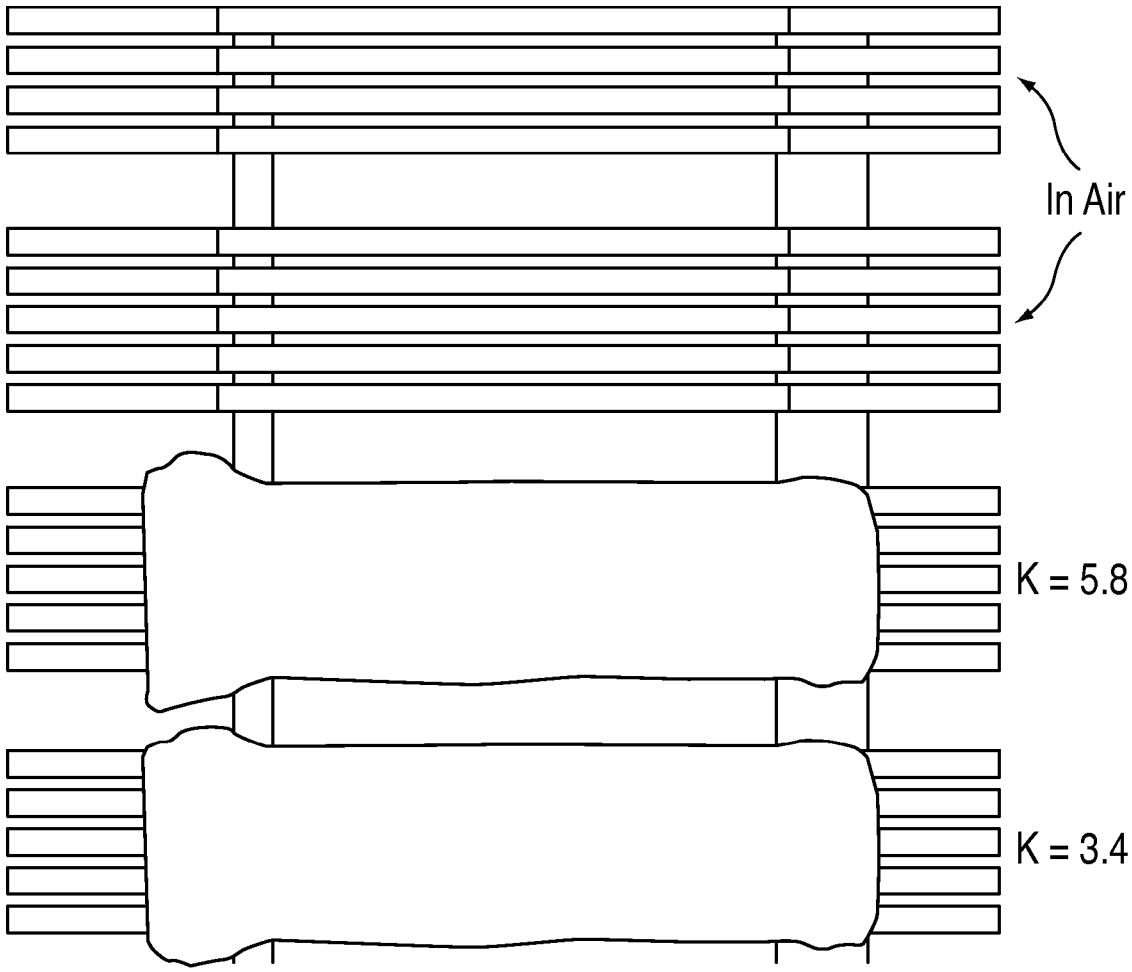
FIG. 5 depicts components for testing the efficacy of the teachings herein.

To further support the idea disclosed in this invention, an experiment was designed, and measurements were performed. FIG. 5 shows an analogical setup using parallel ribbon bonds, which has similar coupling effects as copper pins used in DIMM connectors 10. Each group of the ribbon bonds contains five parallel ribbons. The ribbons used were of 75 μm in width, bonded at a 150 μm pitch (75 μm gap). The span (length) for each of the ribbons was 2 mm, which is about half of the pin length in a DIMM connector 10. A first group having two sets of ribbons were exposed to the air, which gives high impedance. For the two sets in air, crosstalk was dominated by inductive coupling, which is similar to the prior art DIMM connector 10. Measurements were duplicated on the two sets in air to confirm bonding repeatability. A second group included two sets of ribbons where each set was covered with glob-top material. One set included material having a dielectric constant K of about 3.4. The second set (second up from the bottom of FIG. 5) was covered with a mixture of glob-top material and 5 μm alumina ($Al_2O_3$) ceramic particles (K=9.2) mixed therein in a 1:1 volume ratio. The resulting dielectric constant K being about 5.8.

Measurements were performed on the ribbons with an Agilent 4-port network analyzer. 225 μm pitch GS and SG microwave probes were used to land on the bonding pads of the ribbons. In each configuration, the center ribbon was used as common ground, and the two ribbons adjacent to the center ribbon were used for crosstalk tests. This is in a similar configuration as the contact pins 5 in a DIMM connector 10.

Figure 6:
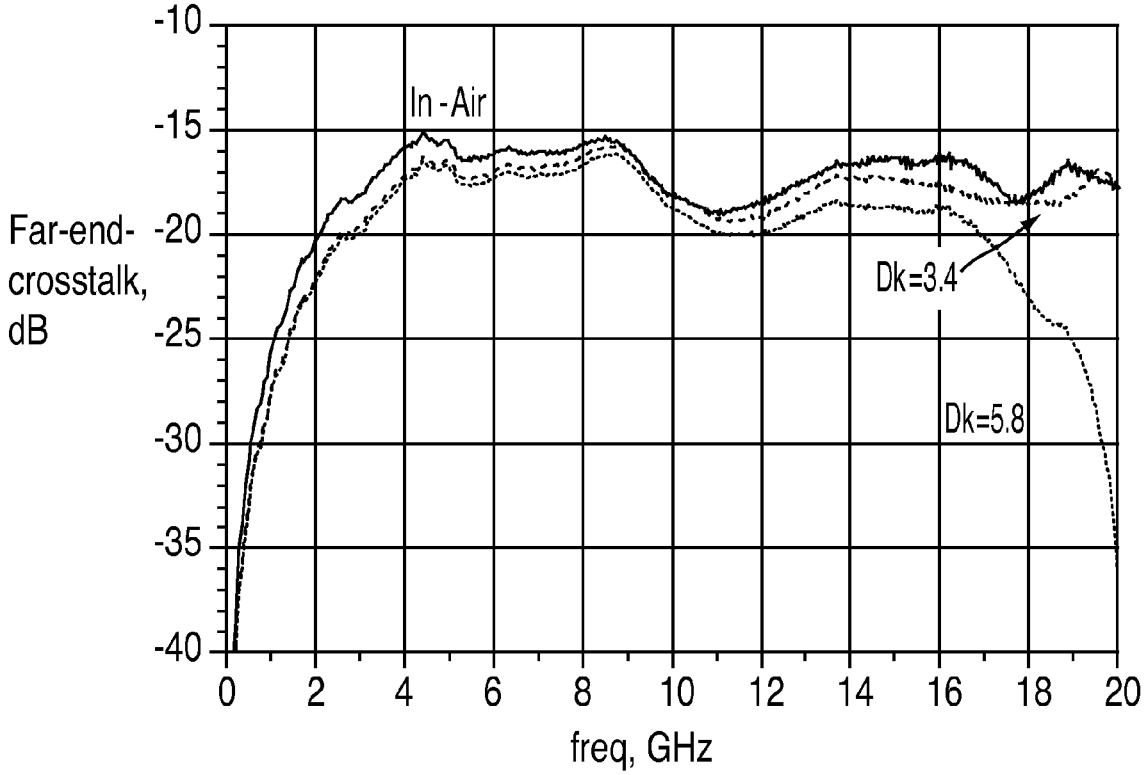
FIG. 6 is a graph depicting results from the testing assembly of FIG. 5.

FIG. 6 depicts aspects of performance for these tests, "in-air", "K=3.4", and "K=5.8." With the application of generic glob-top material (K=3.4), far-end-crosstalk is reduced by about 2 dB below 6 GHz. By further increasing the dielectric constant K from 3.4 to 5.8, the far-end-crosstalk remains about the same up to an operating frequency of about 10 GHz, and decreases for frequencies above about 10 GHz. This result indicates that, for the specific ribbon bond structures, crosstalk reduction might be optimal with a dielectric constant K of about 5, which was also confirmed by simulations for the ribbon bonds.

From the results of the above simple experiment, it is shown that far-end-crosstalk may be reduced by adjusting the dielectric constant of the media (from 1 to 5.8 in the example), as proposed in this invention.

One or more aspects of the present invention can be included in an article of manufacture (e.g., one or more computer program products) having, for instance, computer usable media. The media has embodied therein, for instance, computer readable program code means for providing and facilitating the capabilities of the present invention. The article of manufacture can be included as a part of a computer system or sold separately.

Additionally, at least one program storage device readable by a machine, tangibly embodying at least one program of instructions executable by the machine to perform the capabilities of the present invention can be provided.

The flow diagrams depicted herein are just examples. There may be many variations to these diagrams or the steps (or operations) described therein without departing from the spirit of the invention. For instance, the steps may be performed in a differing order, or steps may be added, deleted or modified. All of these variations are considered a part of the claimed invention.

While the preferred embodiment to the invention has been described, it will be understood that those skilled in the art, both now and in the future, may make various improvements and enhancements which fall within the scope of the claims which follow. These claims should be construed to maintain the proper protection for the invention first described.

What is claimed is:

1. A method for fabricating a DIMM connector, comprising:

assembling a plurality of pins adapted for coupling to circuit components, wherein the pins provide for communicating input and output signals with the circuit components, mixing high dielectric constant ceramic particles within material for jacketing at least a portion of each of the pins in the plurality; and jacketing the at least a portion of each of the pins with the mix of particles and material to form a connector housing;

further comprising:

determining a dielectric constant $\in$ for the connector housing according to the formula:

$$\in=[\in_1^{1/3}+v_2(\in_2^{1/3}-\in_1^{1/3})]^3$$

where $\in_1$ represents a dielectric constant of the material, $\in_2$ represents a dielectric constant of the ceramic particles; and $v_2$ represents a volume fraction of the ceramic particles in the material.

* * * * *